US011103868B2

(12) United States Patent
Pang et al.

(10) Patent No.: US 11,103,868 B2
(45) Date of Patent: Aug. 31, 2021

(54) MICROFLUIDIC CHIP, BIOLOGICAL DETECTION DEVICE AND METHOD

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Fengchun Pang, Beijing (CN); Peizhi Cai, Beijing (CN); Yue Geng, Beijing (CN); Le Gu, Beijing (CN); Yingying Zhao, Beijing (CN); Haochen Cui, Beijing (CN); Nan Zhao, Beijing (CN); Yuelei Xiao, Beijing (CN); Hui Liao, Beijing (CN); Chuncheng Che, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 286 days.

(21) Appl. No.: 16/338,042

(22) PCT Filed: Oct. 11, 2018

(86) PCT No.: PCT/CN2018/109781
§ 371 (c)(1),
(2) Date: Mar. 29, 2019

(87) PCT Pub. No.: WO2019/174222
PCT Pub. Date: Sep. 19, 2019

(65) Prior Publication Data

US 2020/0391207 A1 Dec. 17, 2020

(30) Foreign Application Priority Data

Mar. 12, 2018 (CN) ..... 201810198840.1

(51) Int. Cl.
*B01L 3/00* (2006.01)

(52) U.S. Cl.
CPC ... *B01L 3/502707* (2013.01); *B01L 3/502792* (2013.01); *B01L 2200/0673* (2013.01); *B01L 2300/0645* (2013.01)

(58) Field of Classification Search
CPC ..... B01L 2300/0645; B01L 2200/0673; B01L 3/502792; B01L 3/502707
See application file for complete search history.

(56) References Cited

U.S. PATENT DOCUMENTS

2016/0059230 A1* 3/2016 Hsu ..... B01L 3/502784 204/602
2019/0126279 A1* 5/2019 Gach ..... B01L 3/50273

FOREIGN PATENT DOCUMENTS

CN 105572398 A 5/2016
CN 107649223 A 2/2018
CN 108465491 A 8/2018

OTHER PUBLICATIONS

Ui-Chong Yi and Chang-Jin Kim, Characterization of electrowetting actuation on addressable single-side coplanar electrodes, Aug. 25, 2006, Journal of Micromechanics and Microengineering, vol. 16, p. 2053-2059. (Year: 2006).*

(Continued)

*Primary Examiner* — Jennifer Wecker
*Assistant Examiner* — Kathryn Elizabeth Limbaugh
(74) *Attorney, Agent, or Firm* — The Webb Law Firm

(57) ABSTRACT

The present disclosure provides a microfluidic chip, a biological detection device and a method. The microfluidic chip includes: a first substrate and a second substrate that are oppositely disposed; a first electrode and a second electrode that are oppositely disposed between the first substrate and the second substrate, the first electrode including a plurality of spaced first electrode units, and the second electrode (Continued)

including a plurality of spaced second electrode units, wherein the first electrode units are disposed oppositely to the second electrode units in one-to-one correspondence; a first dielectric layer and a second dielectric layer between the first electrode and the second electrode; a first hydrophobic layer and a second hydrophobic layer between the first dielectric layer and the second dielectric layer, wherein a gap is between the first hydrophobic layer and the second hydrophobic layer.

9 Claims, 6 Drawing Sheets

(56) References Cited

OTHER PUBLICATIONS

Chang, Jong-Hyeon et al., Twin-plate electrowetting for efficient digital microfluidics, Sensors and Actuators B, vol. 160, pp. 1581-1585.
First Office Action for CN Appl. No. 201810198840.1, dated Jul. 3, 2019.
International Search Report and Written Opinion for International Appl. No. PCT/CN/2018/109781, dated Mar. 12, 2018.
Mingxiang, Ling, "Research on Manipulation and Control of Droplets Based on Electrowetting on Dielectric", China Excellent Master's Degree Full-text Database Information Technology Series, No. 5, May 15, 2012.

* cited by examiner

MICROFLUIDIC CHIP, BIOLOGICAL DETECTION DEVICE AND METHOD

CROSS-REFERENCE TO RELATED APPLICATIONS

The present application is a U.S. National Stage Application under 35 U.S.C. § 371 of International Patent Application No. PCT/CN2018/109781, filed on Oct. 11, 2018, which claims priority to Chinese Patent Application No. 201810198840.1 filed on Mar. 12, 2018, the disclosure of both of which are incorporated by reference herein in entirety.

TECHNICAL FIELD

The present disclosure relates to a microfluidic chip, a biological detection device and a method.

BACKGROUND

The microfluidic chip technology may integrate basic operation units such as sample preparation, reaction, separation and detection in biological, chemical and medical analysis processes onto a micrometer-scale chip, to automatically complete the entire analysis process. Since the cost may be reduced by using the microfluidic chip and the microfluidic chip has such advantages as short detection time and high sensitivity, the microfluidic chip has showed great prospect in biological, chemical, and medical fields and the like.

In recent years, the numerical microfluidic technology based on the dielectric wetting technology by which discrete droplets may be controlled with such advantages as low reagent consumption, low cost, no cross-contamination, being able to controlling droplets individually, and easy implementation of an integrated portable system, has become a research hotspot in the scientific research community.

SUMMARY

According to one aspect of embodiments of the present disclosure, a microfluidic chip is provided. The microfluidic chip comprises: a first substrate and a second substrate that are oppositely disposed; a first electrode and a second electrode that are oppositely disposed between the first substrate and the second substrate, the first electrode comprising a plurality of spaced first electrode units, and the second electrode comprising a plurality of spaced second electrode units, wherein the first electrode units are disposed oppositely to the second electrode units in one-to-one correspondence; a first dielectric layer and a second dielectric layer that are between the first electrode and the second electrode; and a first hydrophobic layer and a second hydrophobic layer that are between the first dielectric layer and the second dielectric layer, wherein a gap is between the first hydrophobic layer and the second hydrophobic layer.

In some embodiments, a plurality of spaced first pins connected to the first electrode are provided on the first substrate, wherein the first pins are connected to the first electrode units in one-to-one correspondence; and a plurality of spaced second pins connected to the second electrode are provided on the second substrate, wherein the second pins are connected to the second electrode units in one-to-one correspondence, the first pins are disposed oppositely to the second pins in one-to-one correspondence; wherein each first pin is adhered and electrically connected to a corresponding second pin by a conductive adhesive.

In some embodiments, the conductive adhesive comprises metal particles, at least one of the metal particles being between one of the first pins and the corresponding one of the second pins, such that one of the first electrode units corresponding to the one of the first pins is electrically connected to one of the second electrode units corresponding to the one of the second pins.

According to another aspect of embodiments of the present disclosure, a biological detection device is provided. The device comprises the microfluidic chip as described above.

According to another aspect of embodiments of the present disclosure, a method for manufacturing a microfluidic chip is provided. The method comprises: forming a patterned first electrode on a first substrate, and forming a patterned second electrode on a second substrate, wherein the first electrode comprises a plurality of spaced first electrode units, and the second electrode comprises a plurality of spaced second electrode units; forming a first dielectric layer on the first electrode, and forming a second dielectric layer on the second electrode; forming a first hydrophobic layer on the first dielectric layer, and forming a second hydrophobic layer on the second dielectric layer; and disposing oppositely the first substrate and the second substrate, such that the first electrode, the second electrode, the first dielectric layer, the second dielectric layer, the first hydrophobic layer, and the second hydrophobic layer are all between the first substrate and the second substrate, wherein a gap is formed between the first hydrophobic layer and the second hydrophobic layer.

In some embodiments, before forming the first dielectric layer and the second dielectric layer, the method further comprises: forming a plurality of spaced first pins connected to the first electrode on the first substrate, wherein the first pins are connected to the first electrode units in one-to-one correspondence; and forming a plurality of spaced second pins connected to the second electrode on the second substrate, wherein the second pins are connected to the second electrode units in one-to-one correspondence; wherein in the step of disposing oppositely the first substrate and the second substrate, the first pins are disposed oppositely to the second pins in one-to-one correspondence.

In some embodiments, the step of disposing oppositely the first substrate and the second substrate comprises: adhering and electrically connecting each first pin to a corresponding second pin by a conductive adhesive.

According to another aspect of embodiments of the present disclosure, a method for moving a sample droplet using the microfluidic chip as described above is provided. The method comprises: introducing a sample droplet into the gap of the microfluidic chip; and applying sequentially a plurality of groups of driving signals to the first electrode and the second electrode that are oppositely disposed to move the sample droplet, wherein applying each group of driving signals comprises: applying a driving voltage to one of the first electrode units and a driving voltage to one of the second electrode units, wherein the one of the first electrode units and the one of the second electrode units are closest to the sample droplet on a moving direction side of the sample droplet, and the driving voltage applied to the one of the first electrode units has the same polarity as the driving voltage applied to the one of the second electrode units, and applying a ground voltage to remaining first electrode units and remaining second electrode units.

In some embodiments, the driving voltage applied to the one of the first electrode units is equal to the driving voltage applied to the one of the second electrode units.

According to another aspect of embodiments of the present disclosure, a method for separating a sample droplet using the microfluidic chip as described above is provided. The method comprises: introducing a sample droplet into the gap of the microfluidic chip; and applying a first group of driving voltages to at least one group of electrode units on one side of the sample droplet, and applying a second group of driving voltages having the same polarity as the first group of driving voltages to at least one group of electrode units on another side of the sample droplet, to separate the sample droplet, wherein each group of electrode units comprises one of the first electrode units and a second electrode unit disposed oppositely to the one of the first electrode units, and each group of driving voltages comprises a driving voltage applied to the one of the first electrode units and a driving voltage applied to the second electrode unit.

In some embodiments, the step of applying the first group of driving voltages and the second group of driving voltages comprises: applying the first group of driving voltages to one group of electrode units on the one side of the sample droplet and closest to the sample droplet, and applying the second group of driving voltages to another group of electrode units on the other side of the sample droplet and closest to the sample droplet.

In some embodiments, the driving voltage applied to the one of the first electrode units is equal to the driving voltage applied to the second electrode unit.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate embodiments of the present disclosure and, together with this specification, serve to explain the principles of the present disclosure.

The present disclosure may be more clearly understood from the following detailed description with reference to the accompanying drawings, in which.

Figure 1:
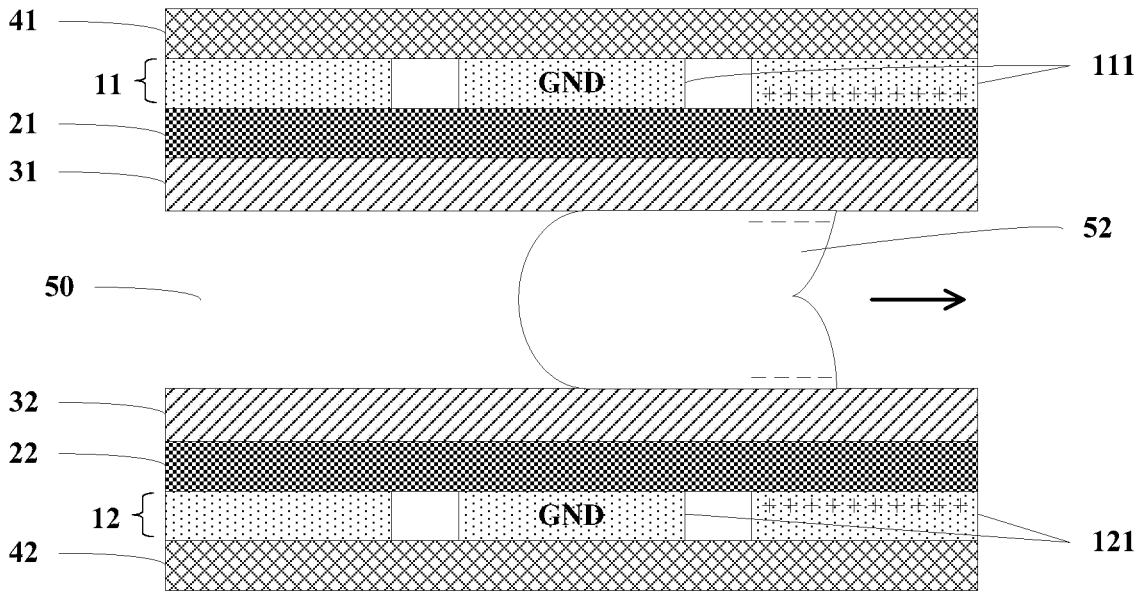
FIG. 1 is a cross-sectional view schematically showing a microfluidic chip according to an embodiment of the present disclosure.

It should be understood that the dimensions of the various parts shown in the drawings are not drawn to the actual scale. In addition, the same or similar reference signs are used to denote the same or similar components.

DETAILED DESCRIPTION

Various exemplary embodiments of the present disclosure will now be described in detail with reference to the accompanying drawings. The following description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "includes" or variants thereof means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

Unless otherwise defined, all terms (comprising technical and scientific terms) used herein have the same meanings as the meanings commonly understood by one of ordinary skill in the art to which the present disclosure belongs. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

At present, numerical microfluidic chips may be divided into two categories: single-substrate structure and dual-substrate structure. The single-substrate structure which is relatively simple and easy to integrate into a circuit, has such disadvantages as the droplets being easily evaporated and contaminated, and it being difficult to implement droplet separation. The dual-substrate structure which may implement droplet separation is relatively complicated and difficultly fabricated with a great upper substrate resistance and a great lower substrate resistance. Currently, the numerical microfluidic chip based on the dual-substrate structure typically requires a driving voltage to be applied to an electrode on one side of the gap. For example, the driving voltage may be tens to hundreds of volts.

The inventor of the present disclosure has found that, since the numerical microfluidic chip based on the dual-substrate structure in the related art typically requires a driving voltage to be applied to an electrode on one side of the gap, the applied driving voltage is relatively high, so that it is easy to result in breakdown of the chip.

In view of this, embodiments of the present disclosure provide a microfluidic chip structure, by which a driving voltage applied to the microfluidic chip is reduced and the breakdown of the chip may be prevented. The structure of the microfluidic chip according to some embodiments of the present disclosure will be described in detail below with reference to the accompanying drawings.

FIG. 1 is a cross-sectional view schematically showing a microfluidic chip according to an embodiment of the present disclosure. For example, the microfluidic chip is a numerical microfluidic chip.

As shown in FIG. 1, the microfluidic chip comprise: a first substrate 41 and a second substrate 42 that are oppositely disposed; a first electrode 11 and a second electrode 12 that are oppositely disposed between the first substrate 41 and the second substrate 42; a first dielectric layer 21 and a second dielectric layer 22 that are between the first electrode 11 and the second electrode 12; and a first hydrophobic layer 31 and a second hydrophobic layer 32 that are between the first dielectric layer 21 and the second dielectric layer 22. A gap 50 is between the first hydrophobic layer 31 and the second hydrophobic layer 32. This gap 50 may be configured to introduce a sample droplet 52.

In some embodiments, materials of the first substrate 41 and the second substrate 42 comprise glass, quartz, or plastic and the like.

As shown in FIG. 1, the first electrode 11 comprises a plurality of spaced first electrode units 111, and the second electrode 12 comprises a plurality of spaced second electrode units 121. The first electrode units 111 are disposed oppositely to the second electrode units 121 in one-to-one correspondence. In the embodiments of the present disclosure, an electrode comprising a plurality of spaced electrode units may be referred to as an array electrode. For example, the first electrode and the second electrode here are both array electrodes.

It should be noted that the term "disposed oppositely" as described in the embodiments of the present disclosure means that, for two structural layers disposed on both sides of the gap, the positions at which they are situated cause that when such two structural layers respectively project to a plane in which one of such two structural layers is situated, such two projections at least partially overlap (e.g., completely overlap). For example, the first electrode unit 111 and the second electrode unit 121 are oppositely disposed, that is, the projection of the first electrode unit 111 on the upper side of the gap on the plane in which the second electrode unit 121 is situated completely overlaps with the projection of the second electrode unit 121 on the lower side of the gap on the plane in which the second electrode unit 121 is situated.

In some embodiments, as shown in FIG. 1, the first electrode 11 is on one side of the first substrate 41 close to the gap 50, and the second electrode 12 is on one side of the second substrate 42 close to the gap 50. For example, materials of the first electrode 11 and the second electrode 12 comprise ITO (Indium Tin Oxide), or a metal such as Mo (molybdenum), Al (aluminum), or Cu (copper).

As shown in FIG. 1, the first dielectric layer 21 is on one side of the first electrode 11 close to the gap 50, and the second dielectric layer 22 is on one side of the second electrode 12 close to the gap 50. The first dielectric layer 21 and the second dielectric layer 22 are oppositely disposed. For example, materials of the first dielectric layer 21 and the second dielectric layer 22 comprise an insulating material such as SiNx (silicon nitride), SiO2 (silicon dioxide), a negative photoresist (such as SU-8 photoresist) or resin.

As shown in FIG. 1, the first hydrophobic layer 31 is on one side of the first dielectric layer 21 close to the gap 50, and the second hydrophobic layer 32 is on one side of the second dielectric layer 22 close to the gap 50. For example, materials of the first hydrophobic layer 31 and the second hydrophobic layer 32 comprise a fluoride material such as Teflon or parylene.

In the microfluidic chip of the above-described embodiment, the first electrode are provided on the upper side of the gap and the second electrode are provided on the lower side of the gap. Here, the first electrode comprises a plurality of spaced first electrode units, and the second electrode comprises a plurality of spaced second electrode units. That is, the first electrode and the second electrode are both array electrodes. By this, in the process of moving a sample droplet or separating a sample droplet using the microfluidic chip, a driving voltage may be applied to the first electrode unit on the upper side of the gap and another driving voltage may be applied to the second electrode unit on the lower side of the gap, wherein the first electrode unit corresponds to the second electrode unit. Compared to the case in the known related art that a driving voltage can only be applied to an electrode on one side of the gap, the driving voltages applied to the microfluidic chip of embodiments of the present disclosure are lower. Therefore, the risk of the breakdown of the chip may be reduced.

For example, as shown in FIG. 1, in the process of rightward movement of the sample droplet 52, a positive voltage may be applied to the first electrode unit on the right side of the droplet 52 and another positive voltage may be applied to the second electrode unit on the right side of the droplet 52, wherein the first electrode unit corresponds to the second electrode unit. The positive voltages thus applied may induce an equal amount of negative charges at the upper and lower corners on the right side of the droplet. Since there are charges of the same polarity in the upper and lower sides of the droplets, a repulsive force between the charges of the same polarity is increased, so that the droplet is more easily spread, and a surface tension in the solid-liquid interface is reduced, so that the droplet is changed from a hydrophobic state to a hydrophilic state. Moreover, since a driving voltage is applied to only one of the upper and lower electrodes of the microfluidic chip in the related art, the droplet is changed into a hydrophilic state only on one side. Therefore, compared with the related art, in the case of having the same driving voltage, the droplet within the microfluidic chip of embodiments of the present disclosure has a larger hydrophilic area, thereby a driving force of the droplet is increased. In this way, compared with the related art, in the case that the same driving force is required, the microfluidic chip of embodiments of the present disclosure has lower driving voltages, so that the chip is not vulnerable to breakdown.

In some embodiments, each of the first electrode units 111 and the corresponding second electrode unit 121 are symmetrically disposed with respect to the gap 50. For example, each of the first electrode units has the same area or shape as the corresponding second electrode unit, and the position of each of the first electrode units and the position of the corresponding second electrode unit are symmetrical with respect to the gap. In this way, it is favorable that the induced charge distribution on the surface of the droplet is as symmetrical as possible when the same driving voltage is applied to the first electrode unit and the second electrode unit that are oppositely disposed. Thereby, the movement of the droplet may be better controlled, and the driving voltage may be reduced as much as possible to prevent breakdown of the chip.

Figure 2:
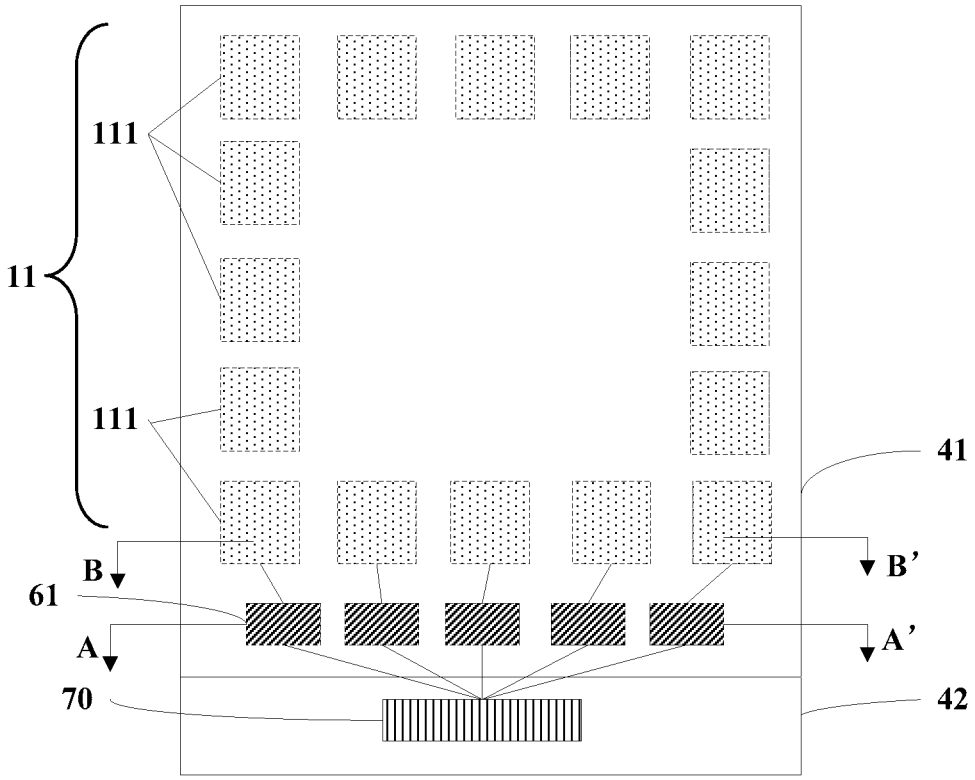
FIG. 2 is a top view schematically showing a microfluidic chip according to an embodiment of the present disclosure.

FIG. 2 is a top view schematically showing a microfluidic chip according to an embodiment of the present disclosure. It should be noted that, for the ease of description, the first electrode units 111 of the first electrode 11 are shown in FIG. 2. It should also be noted that, although a plurality of first electrode units shown in FIG. 2 (or a plurality of second electrode units not shown in FIG. 2) are enclosed in a rectangle, those skilled in the art should understand that, these plurality of first electrode units (or the plurality of second electrode units) may also be enclosed in other shapes such as a circle or the like. Therefore, the scope of embodiments of the present disclosure is not limited thereto. In addition, a lead pad 70 for connecting to other integrated circuits is also shown in FIG. 2. The structure in FIG. 2 is shown with a dotted line edge, which indicates that the structure is below the first substrate 41.

Figure 3:
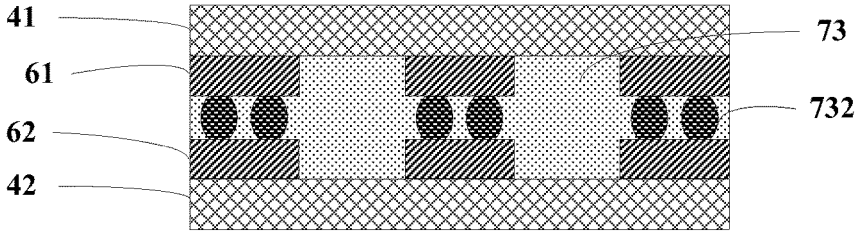
FIG. 3 is a cross-sectional view schematically showing a partial structure of a microfluidic chip taken along a line A-A' in FIG. 2 according to an embodiment of the present disclosure.

FIG. 3 is a cross-sectional view schematically showing a partial structure of a microfluidic chip taken along a line A-A' in FIG. 2 according to an embodiment of the present disclosure. In addition, it is to be noted that, FIG. 1 is a cross-sectional view schematically showing a partial structure of the microfluidic chip taken along line B-B' in FIG. 2 according to some embodiments of the present disclosure.

The structure of the microfluidic chip according to some embodiments of the present disclosure is described in further detail below with reference to FIGS. 2 and 3.

In some embodiments, as shown in FIGS. 2 and 3, a plurality of spaced first pins 61 connected to the first electrode 11 are provided on the first substrate 41. The first pins 61 are connected to the first electrode units 111 in one-to-one correspondence. It should be noted that, for the ease of illustration, only the first pins corresponding to partial first electrode units are shown in FIG. 2, but those skilled in the art should understand that, each of the first pins is respectively connected to a corresponding first electrode unit.

In some embodiments, as shown in FIG. 3, a plurality of spaced second pins 62 connected to the second electrode 12 are provided on the second substrate 42. The second pins 62 are connected to the second electrode units 121 in one-to-one correspondence.

Here, the first pins 61 are disposed oppositely to the second pins 62 in one-to-one correspondence. In some embodiments, as shown in FIG. 3, each first pin 61 is adhered and electrically connected to the corresponding second pin 62 by a conductive adhesive 73. For example, as shown in FIG. 3, the conductive adhesive 73 may comprise metal particles 732. At least one of the metal particles 732 is between one of the first pins 61 and the corresponding one of the second pins 62, such that one of the first electrode units 111 corresponding to the one of the first pins 61 (that is, connected to the one of the first pins 61) is electrically connected to one of the second electrode units 121 corresponding to the one of the second pins 62 (that is, connected to the one of the second pins 62). The one of the first electrode units 111 is disposed oppositely to the one of the second electrode units 121. By leading pins of the first electrode and the second electrode to a peripheral circuit, the pins of the first electrode and the second electrode are connected by a conductive adhesive, so that a driving voltage is applied to the first electrode unit and another driving voltage is applied to the corresponding second electrode unit by the same circuit, to control movement or separation of the droplet in the gap.

In the above-described embodiment, the pins of the first electrode are electrically connected to the pins of the second electrode at the periphery of the chip using the conductive adhesive. By controlling the distribution density of the metal particles and the spacing of the pins, there is no overlap between the metal particles so that it is only possible to electrically connect the first electrode unit to the corresponding second electrode unit without causing short-circuit to adjacent pins. This reduces the difficulty in manufacturing the chip, and facilitates the fabrication of large-scale integrated circuits without a requirement for a complicated process. Therefore, the microfluidic chip of embodiments of the present disclosure is not only simple in structure but also relatively easy in its manufacturing process.

In the above-described embodiment, the first electrode unit is electrically connected to the second electrode unit by the conductive adhesive, wherein the first electrode unit and the second electrode unit are oppositely disposed, so that the same driving voltage may be applied to the first electrode unit and the corresponding second electrode unit to control the movement of the droplet. However, the scope of embodiments of the present disclosure is not limited thereto. Those skilled in the art can understand that a driving voltage may be applied to the first electrode unit and another driving voltage may be applied to the corresponding second electrode unit. For example, the driving voltage applied to the first electrode unit is equal or unequal to the other driving voltage applied to the corresponding second electrode unit.

In embodiments of the present disclosure, a biological detection device is also provided. The biological detection device comprises the microfluidic chip as described above, such as the microfluidic chip as shown in FIG. 1.

Figure 4:
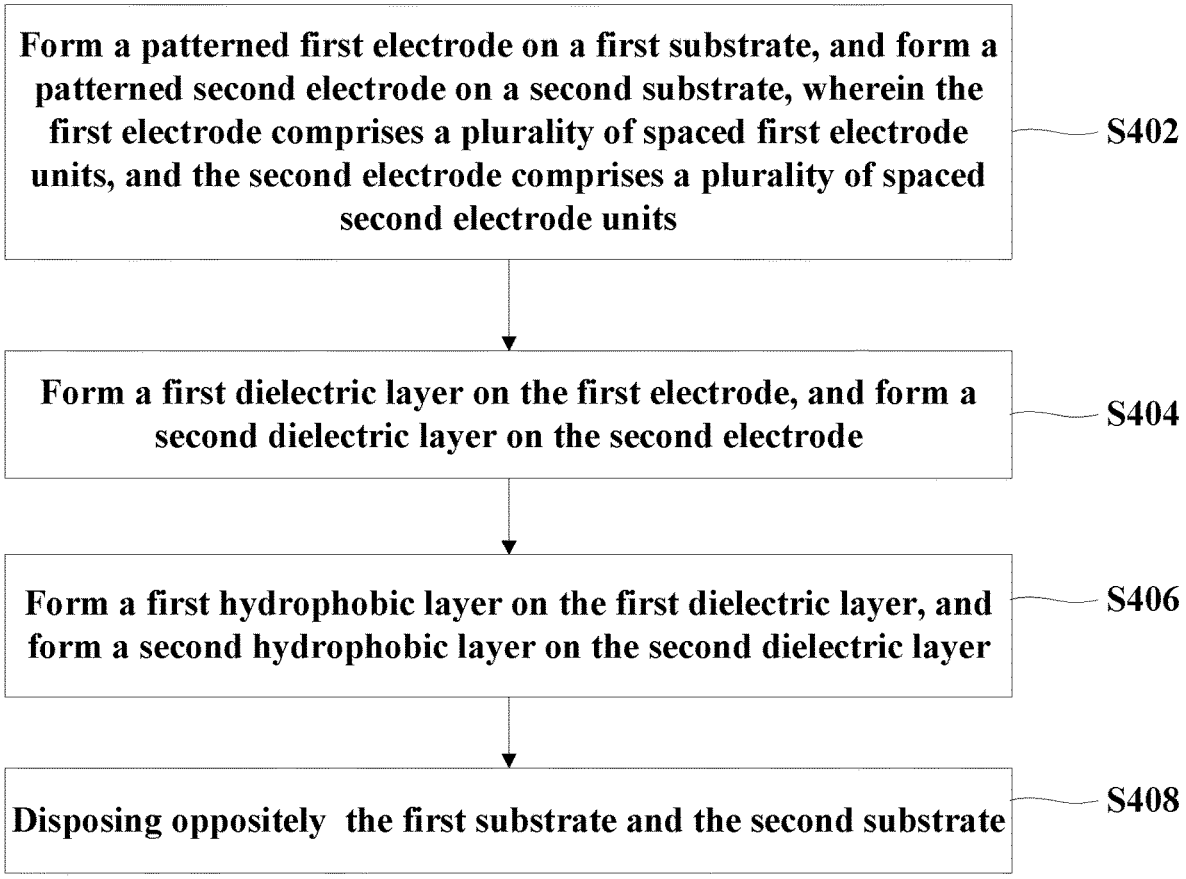
FIG. 4 is a flow chart showing a method for manufacturing a microfluidic chip according to an embodiment of the present disclosure.

FIG. 4 is a flow chart showing a method for manufacturing a microfluidic chip according to an embodiment of the present disclosure. FIGS. 5A-5B, 6A-6B, 7A-7B and 8 are cross-sectional views that schematically show the structures of several stages in the manufacturing process of a microfluidic chip according to some embodiments of the present disclosure. A method for manufacturing a microfluidic chip according to some embodiments of the present disclosure will be described in detail below with reference to FIGS. 4, 5A to 5B, 6A to 6B, 7A to 7B, and 8.

As shown in FIG. 4, in step S402, a patterned first electrode is formed on a first substrate, and a patterned second electrode is formed on a second substrate, wherein the first electrode comprises a plurality of spaced first electrode units, and the second electrode comprises a plurality of spaced second electrode units.

Figure 5A:
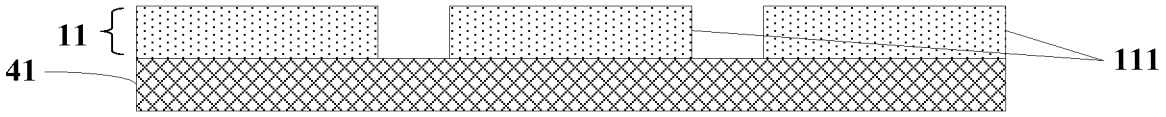
FIG. 5A is a cross-sectional view schematically showing a part of the structure in step S402 in FIG. 4.
Figure 5B:
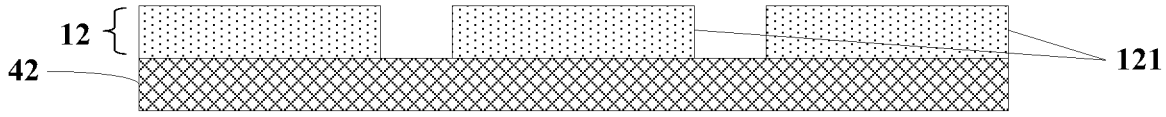
FIG. 5B is a cross-sectional view schematically showing another part of the structure in step S402 in FIG. 4.

FIG. 5A is a cross-sectional view schematically showing a part of the structure in step S402 in FIG. 4. FIG. 5B is a cross-sectional view schematically showing another part of the structure in step S402 in FIG. 4. As shown in FIGS. 5A and 5B, by a process such as deposition, photolithography, and etching, a patterned first electrode 11 is formed on a first substrate 41, and a patterned second electrode 12 is formed on a second substrate 42. The first electrode 11 comprises a plurality of spaced first electrode units 111, and the second electrode 12 comprises a plurality of spaced second electrode units 121.

Returning to FIG. 4, in step S404, a first dielectric layer is formed on the first electrode, and a second dielectric layer is formed on the second electrode.

Figure 6A:
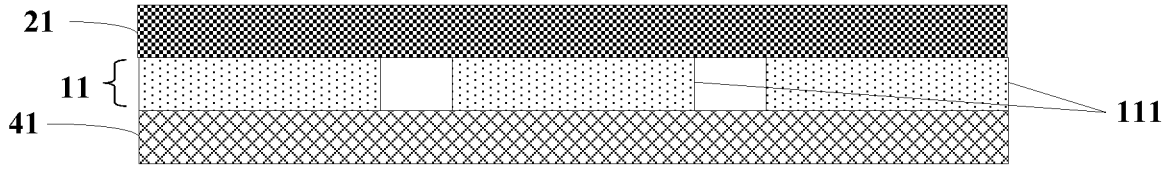
FIG. 6A is a cross-sectional view schematically showing a part of the structure in step S404 in FIG. 4.
Figure 6B:
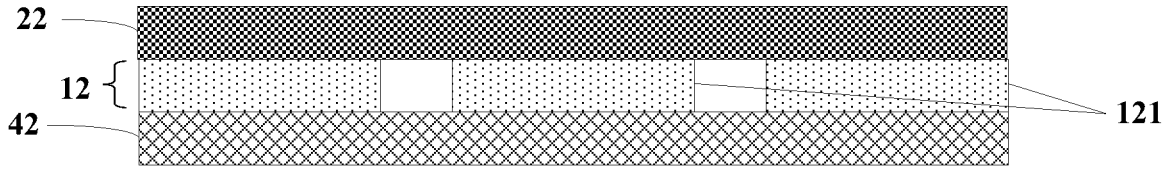
FIG. 6B is a cross-sectional view schematically showing another part of the structure in step S404 in FIG. 4.

FIG. 6A is a cross-sectional view schematically showing a part of the structure in step S404 in FIG. 4. FIG. 6B is a cross-sectional view schematically showing another part of the structure in step S404 in FIG. 4. As shown in FIGS. 6A and 6B, by a process such as deposition, a first dielectric layer 21 is formed on the first electrode 11, and a second dielectric layer 22 is formed on the second electrode 12.

Returning to FIG. 4, in step S406, a first hydrophobic layer is formed on the first dielectric layer, and a second hydrophobic layer is formed on the second dielectric layer.

Figure 7A:
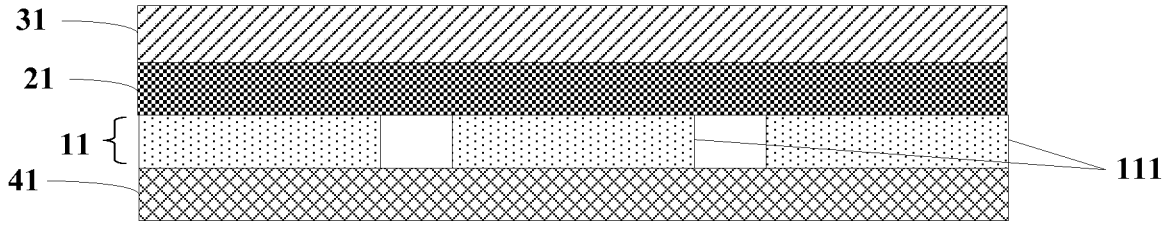
FIG. 7A is a cross-sectional view schematically showing a part of the structure in step S406 in FIG. 4.
Figure 7B:
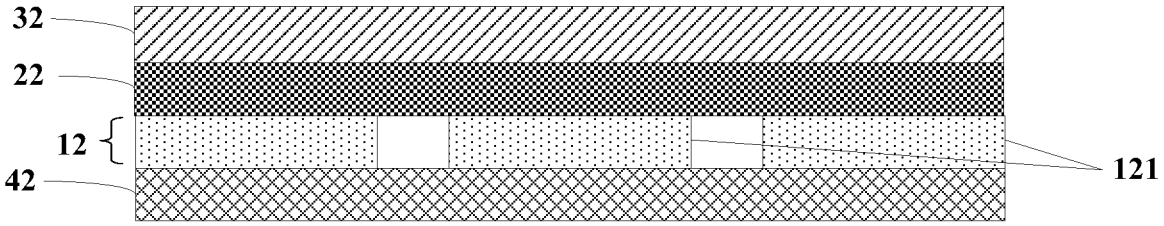
FIG. 7B is a cross-sectional view schematically showing another part of the structure in step S406 in FIG. 4.

FIG. 7A is a cross-sectional view schematically showing a part of the structure in step S406 in FIG. 4. FIG. 7B is a cross-sectional view schematically showing another part of the structure in step S406 in FIG. 4. As shown in FIGS. 7A and 7B, by a process such as deposition, a first hydrophobic layer 31 is formed on the first dielectric layer 21, and a second hydrophobic layer 32 is formed on the second dielectric layer 22.

Returning to FIG. 4, in step S408, the first substrate and the second substrate are oppositely disposed.

Figure 8:
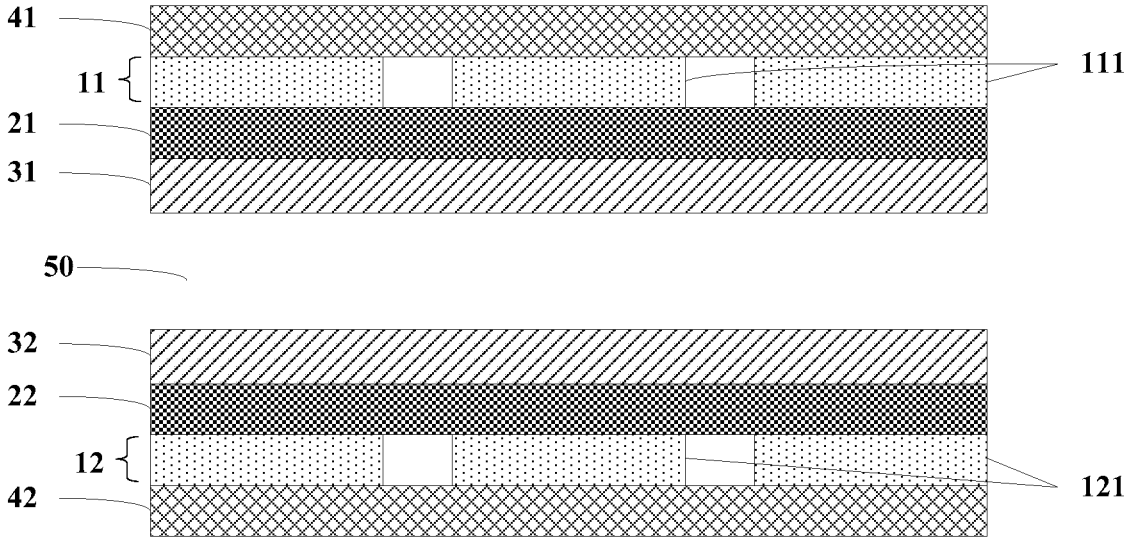
FIG. 8 is a cross-sectional view schematically showing the structure in step S408 in FIG. 4.

FIG. 8 is a cross-sectional view schematically showing the structure in step S408 in FIG. 4. As shown in FIG. 8, the first substrate 41 and the second substrate 42 are oppositely disposed, such that the first electrode 11, the second electrode 12, the first dielectric layer 21, the second dielectric layer 22, the first hydrophobic layer 31, and the second hydrophobic layer 32 are all between the first substrate 41 and the second substrate 42. A gap 50 is formed between the first hydrophobic layer 31 and the second hydrophobic layer 32.

In a method of the above-described embodiment, the patterned first electrode is formed on the first substrate, and the patterned second electrode is formed on the second substrate, wherein the first electrode and the second electrode are both array electrodes. The first dielectric layer is formed on the first electrode, and the second dielectric layer is formed on the second electrode. The first hydrophobic layer is formed on the first dielectric layer, and the second hydrophobic layer is formed on the second dielectric layer. The first substrate and the second substrate are oppositely disposed. By this, a microfluidic chip according to embodiments of the present disclosure is formed. The procedure of the manufacturing process is relatively simple and easy to implement.

In some embodiments, before forming the first dielectric layer 21 and the second dielectric layer 22, the manufacturing method may further comprise: for example, referring to FIGS. 2 and 3, a plurality of spaced first pins 61 connected to the first electrode 11 are formed on the first substrate 41, wherein the first pins 61 are connected to the first electrode units 111 in one-to-one correspondence; and a plurality of spaced second pins 62 connected to the second electrode 12 are formed on the second substrate 42, wherein the second pins 62 are connected to the second electrode units 121 in one-to-one correspondence. For example, the first pins and the second pins may be simultaneously formed in the process of forming the first electrode and the second electrode. For another example, the first pin and the second pin may be formed after the first electrode and the second electrode are formed. In the step of disposing oppositely the first substrate and the second substrate, the first pins are disposed oppositely to the second pins in one-to-one correspondence.

In some embodiments, the step of disposing oppositely the first substrate 41 and the second substrate 42 comprises: adhering and electrically connecting each first pin to a corresponding second pin by a conductive adhesive. The each first pin and the corresponding second pin are oppositely disposed. For example, the first dielectric layer, the second dielectric layer, the first hydrophobic layer, and the second hydrophobic layer are patterned in the process of forming the first dielectric layer, the second dielectric layer, the first hydrophobic layer, and the second hydrophobic layer, so that the first pins and the second pins are exposed. Then, each first pin is adhered and electrically connected to the corresponding second pin by a conductive adhesive.

In some embodiments, in the process of adhering and electrically connecting each first pin to the corresponding second pin by a conductive adhesive, the distribution density of the metal particles within the conductive adhesive and the spacing of the pins may be controlled by controlling the process conditions (e.g., amount of adhesive application, speed of adhesive application, etc.), so that there is no overlap between the metal particles and the first pin corresponding to the first electrode unit is electrically connected to the second pin corresponding to the corresponding second electrode unit without causing short-circuit to adjacent pins.

Figure 9:
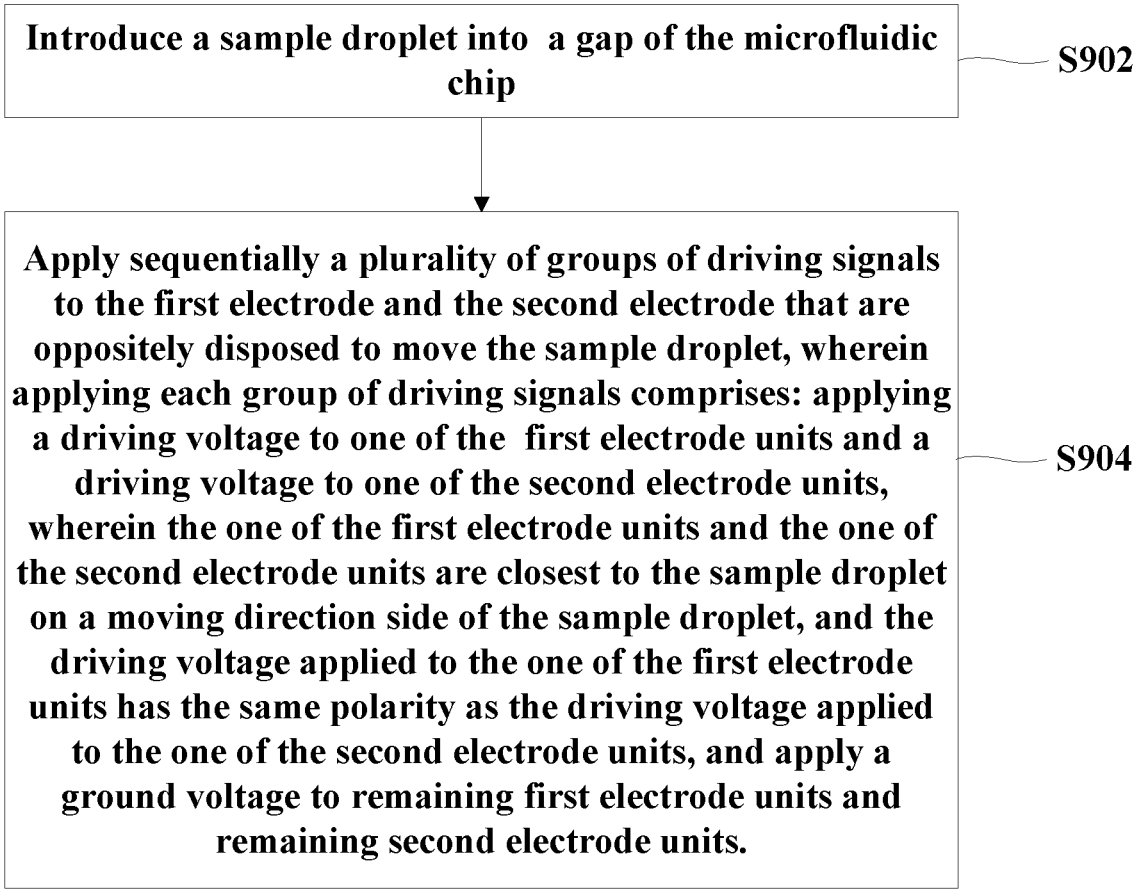
FIG. 9 is a flow chart showing a method for moving a sample droplet using a microfluidic chip according to an embodiment of the present disclosure.

FIG. 9 is a flow chart showing a method for moving a sample droplet using a microfluidic chip according to an embodiment of the present disclosure.

In step S902, a sample droplet is introduced into a gap of the microfluidic chip.

In step S904, a plurality of groups of driving signals are sequentially applied to the first electrode and the second electrode that are oppositely disposed to move the sample droplet, wherein applying each group of driving signals comprises: applying a driving voltage to one of the first electrode units and a driving voltage to one of the second electrode units, wherein the one of the first electrode units and the one of the second electrode units are closest to the sample droplet on a moving direction side of the sample droplet, and the driving voltage applied to the one of the first electrode units has the same polarity as the driving voltage applied to the one of the second electrode units, and a ground voltage is applied to remaining first electrode units and remaining second electrode units.

For example, as shown in FIG. 1, since the sample droplet 52 is required to move rightward, a plurality of groups of driving signals may be sequentially applied to the first electrode and the second electrode that are oppositely disposed to cause the sample droplet to move rightward. Applying each group of driving signals comprises: applying a driving voltage (for example a positive voltage) to the first electrode unit and another driving voltage having the same polarity as the above driving voltage to the second electrode unit, wherein the first electrode unit and the second electrode unit are closest to the sample droplet 52 on the right side of the sample droplet (i.e. a moving direction side of the sample droplet), and applying a ground voltage (GND, for example, the ground voltage may be a low voltage) to the remaining first electrode units and the remaining second electrode units. By this, each time a group of driving signals are applied, the sample droplet 52 move rightward once. By sequentially applying a plurality of groups of driving signals, the sample droplet 52 may be continuously moved rightward. For example, the sample droplet may be moved to a sample detection area (not shown in the figures), so that the biological characteristics of the sample droplet is detected in the sample detection area.

In the above-described method for moving a sample droplet, the polarity of the driving voltage applied to the first electrode unit is the same as the polarity of the driving voltage applied to the second electrode unit. This may make the applied driving voltage reduced as much as possible, so that it is possible to prevent breakdown of the chip as much as possible, and there is a relatively favorable effect in driving the movement of a sample droplet.

In the method for moving a sample droplet by the microfluidic chip in the above-described embodiment, since a driving voltage is applied to the first electrode unit on the upper side of the gap and another driving voltage is applied to the second electrode unit disposed oppositely to the first electrode unit on the lower sides of the gap to drive the movement of the sample droplet, these driving voltages applied may be respectively lower than the driving voltage of the related art, so that it is possible to prevent breakdown of the chip as much as possible.

In some embodiments, the driving voltage applied to the one of the first electrode units is equal to the driving voltage applied to the one of the second electrode units. This makes the driving voltages applied to the two electrode units both relatively low.

Figure 10:
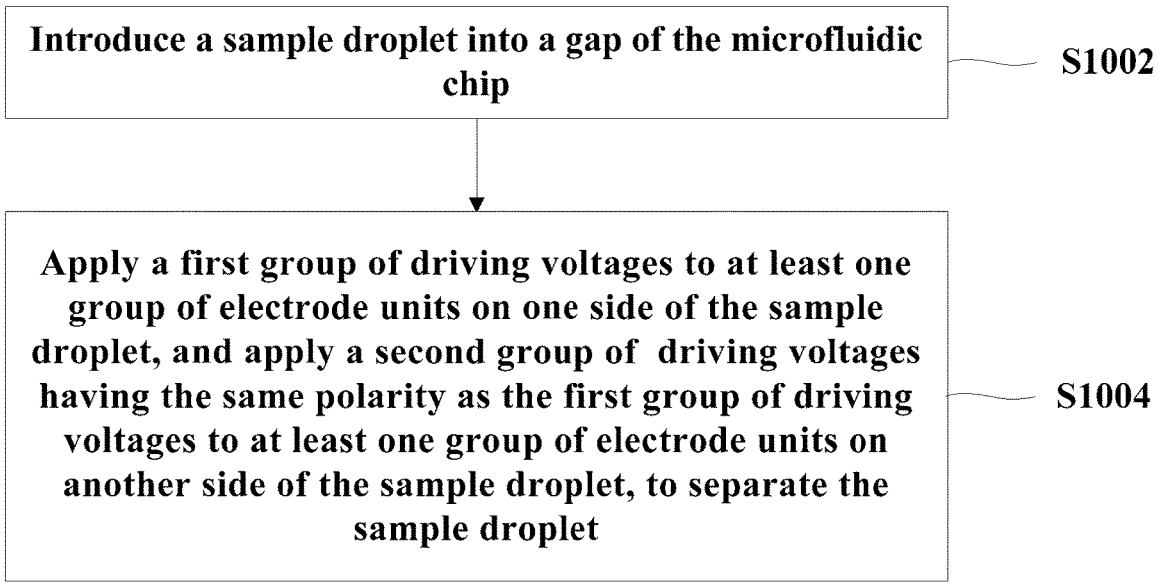
FIG. 10 is a flow chart showing a method for separating a sample droplet using a microfluidic chip according to an embodiment of the present disclosure.

FIG. 10 is a flow chart showing a method for separating a sample droplet using a microfluidic chip according to an embodiment of the present disclosure.

In step S1002, a sample droplet is introduced into a gap of the microfluidic chip.

In step S1004, a first group of driving voltages is applied to at least one group of electrode units on one side of the sample droplet, and a second group of driving voltages having the same polarity as the first group of driving voltages is applied to at least one group of electrode units on another side of the sample droplet, to separate the sample droplet. Each group of electrode units comprises one of the first electrode units and a second electrode unit disposed oppositely to the one of the first electrode units. Each group of driving voltages comprises a driving voltage applied to the one of the first electrode units and a driving voltage applied to the second electrode unit. The one side of the sample droplet is opposite to the other side of the sample droplet.

In some embodiments, the step S1004 may comprise: applying the first group of driving voltages to one group of electrode units on the one side of the sample droplet and closest to the sample droplet, and applying the second group of driving voltages to another group of electrode units on the other side of the sample droplet and closest to the sample droplet.

Figure 11:
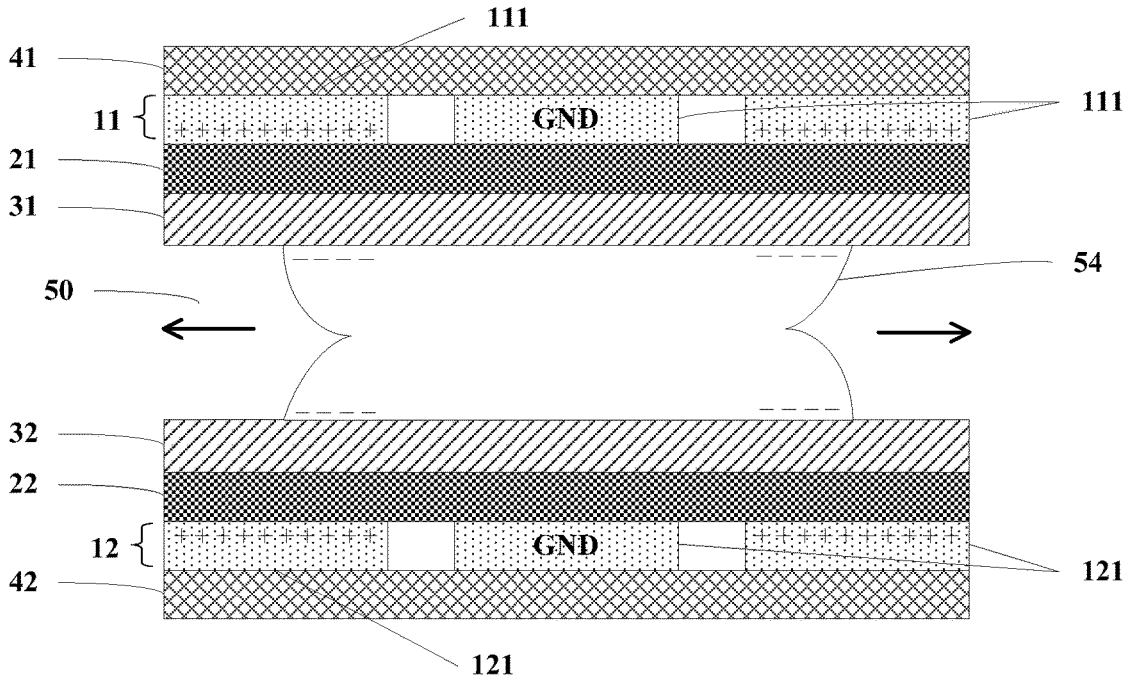
FIG. 11 is a schematic view schematically showing the separation of a sample droplet using a microfluidic chip according to an embodiment of the present disclosure.

For example, FIG. 11 is a schematic view schematically showing the separation of a sample droplet using a microfluidic chip according to an embodiment of the present disclosure. As shown in FIG. 11, the first group of driving voltages (for example, positive voltages) may be applied to one group of electrode units on the left side of the sample droplet 54 and the second group of driving voltages (for example, positive voltages) having the same polarity as the first group of driving voltages may be applied to another group of electrode units on the right side of the sample droplet 54 respectively, so that the left and right portions of the sample droplet 54 are respectively subjected to stretched driving forces, thereby separating the sample droplet.

In the method for separating a sample droplet by the microfluidic chip of the above-described embodiment, since driving voltages having the same polarity are applied to both the first electrode unit on the upper side of the gap and the second electrode unit on the lower side of the gap that are oppositely disposed, the driving voltages may be reduced. Thereby, breakdown of the chip is prevented as much as possible.

In some embodiments, the driving voltage applied to the one of the first electrode units is equal to the driving voltage applied to the second electrode unit disposed oppositely to the one of the first electrode units. This makes the driving voltages relatively low.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments and equivalently substitution of part of the technical features can be made without departing from the scope and spirit of the present disclosure. The scope of the disclosure is defined by the following claims.

What is claimed is:

1. A microfluidic chip, comprising:

a first substrate and a second substrate that are oppositely disposed;

a first electrode and a second electrode that are oppositely disposed between the first substrate and the second substrate, the first electrode comprising a plurality of spaced first electrode units, and the second electrode comprising a plurality of spaced second electrode units, wherein the first electrode units are disposed oppositely to the second electrode units in one-to-one correspondence, a plurality of spaced first pins connected to the first electrode are provided on the first substrate, wherein the first pins are connected to the first electrode units in one-to-one correspondence, and a plurality of spaced second pins connected to the second electrode are provided on the second substrate, wherein the second pins are connected to the second electrode units in one-to-one correspondence, the first pins are disposed oppositely to the second pins in one-to-one correspondence, wherein each first pin is adhered and electrically connected to a corresponding second pin by a conductive adhesive;

a first dielectric layer and a second dielectric layer that are between the first electrode and the second electrode; and a first hydrophobic layer and a second hydrophobic layer that are between the first dielectric layer and the second dielectric layer, wherein a gap is between the first hydrophobic layer and the second hydrophobic layer.

2. The microfluidic chip according to claim 1, wherein the conductive adhesive comprises metal particles, at least one of the metal particles being between one of the first pins and the corresponding one of the second pins, such that one of the first electrode units corresponding to the one of the first pins is electrically connected to one of the second electrode units corresponding to the one of the second pins.

3. A biological detection device, comprising: the microfluidic chip according to claim 1.

4. A method for manufacturing a microfluidic chip, comprising:

forming a patterned first electrode on a first substrate, and forming a patterned second electrode on a second substrate, wherein the first electrode comprises a plurality of spaced first electrode units, and the second electrode comprises a plurality of spaced second electrode units;

forming a first dielectric layer on the first electrode, and forming a second dielectric layer on the second electrode;

forming a first hydrophobic layer on the first dielectric layer, and forming a second hydrophobic layer on the second dielectric layer; and disposing oppositely the first substrate and the second substrate, such that the first electrode, the second electrode, the first dielectric layer, the second dielectric layer, the first hydrophobic layer, and the second hydrophobic layer are all between the first substrate and the second substrate, wherein a gap is formed between the first hydrophobic layer and the second hydrophobic layer, wherein, before forming the first dielectric layer and the second dielectric layer, the method further comprises: forming a plurality of spaced first pins connected to the first electrode on the first substrate, wherein the first pins are connected to the first electrode units in one-to-one correspondence; and forming a plurality of spaced second pins connected to the second electrode on the second substrate, wherein the second pins are connected to the second electrode units in one-to-one correspondence, and wherein, in the disposing oppositely of the first substrate and the second substrate, the first pins are disposed oppositely to the second pins in one-to-one correspondence, and the disposing oppositely of the first substrate and the second substrate comprises: adhering and electrically connecting each first pin to a corresponding second pin by a conductive adhesive.

5. A method for moving a sample droplet using the microfluidic chip according to claim 1, comprising:

introducing a sample droplet into the gap of the microfluidic chip; and applying sequentially a plurality of groups of driving signals to the first electrode and the second electrode that are oppositely disposed to move the sample droplet, wherein applying each group of driving signals comprises: applying a driving voltage to one of the first electrode units and a driving voltage to one of the second electrode units, wherein the one of the first electrode units and the one of the second electrode units are closest to the sample droplet on a moving direction side of the sample droplet, and the driving voltage applied to the one of the first electrode units has the same polarity as the driving voltage applied to the one of the second electrode units, and applying a ground voltage to remaining first electrode units and remaining second electrode units.

6. The method according to claim 5, wherein the driving voltage applied to the one of the first electrode units is equal to the driving voltage applied to the one of the second electrode units.

7. A method for separating a sample droplet using the microfluidic chip according to claim 1, comprising:

introducing a sample droplet into the gap of the microfluidic chip; and applying a first group of driving voltages to at least one group of electrode units on one side of the sample droplet, and applying a second group of driving voltages having the same polarity as the first group of driving voltages to at least one group of electrode units on another side of the sample droplet, to separate the sample droplet, wherein each group of electrode units comprises one of the first electrode units and a second electrode unit disposed oppositely to the one of the first electrode units, and each group of driving voltages comprises a driving voltage applied to the one of the first electrode units and a driving voltage applied to the second electrode unit.

8. The method for separating a sample droplet using a microfluidic chip according to claim 7, wherein the step of applying the first group of driving voltages and the second group of driving voltages comprises:

applying the first group of driving voltages to one group of electrode units on the one side of the sample droplet and closest to the sample droplet, and applying the second group of driving voltages to another group of electrode units on the other side of the sample droplet and closest to the sample droplet.

9. The method according to claim 7, wherein the driving voltage applied to the one of the first electrode units is equal to the driving voltage applied to the second electrode unit.

* * * * *